US009023778B2

(12) United States Patent
Kritzler et al.

(10) Patent No.: US 9,023,778 B2
(45) Date of Patent: May 5, 2015

(54) LOW FOAMING CLEANER

(75) Inventors: Steven Kritzler, Cronulla (AU); Alex Sava, Paddington (AU)

(73) Assignee: Novapharm Research (Australia) Pty Ltd., Rosebury, New South Wales (AU)

( * ) Notice: Subject to any disclaimer, the term of this patent is extended or adjusted under 35 U.S.C. 154(b) by 0 days.

(21) Appl. No.: 12/374,157

(22) PCT Filed: Jul. 18, 2007

(86) PCT No.: PCT/AU2007/000999
§ 371 (c)(1),
(2), (4) Date: Jan. 16, 2009

(87) PCT Pub. No.: WO2008/009053
PCT Pub. Date: Jan. 24, 2008

(65) Prior Publication Data

US 2010/0009884 A1 Jan. 14, 2010

(30) Foreign Application Priority Data

Jul. 18, 2006 (AU) ..... 2006903863
Feb. 7, 2007 (AU) ..... 2007900582

(51) Int. Cl.

| | |
|---|---|
| ***C11D 3/20*** | (2006.01) |
| ***C11D 3/00*** | (2006.01) |
| ***C11D 17/00*** | (2006.01) |
| ***C11D 17/08*** | (2006.01) |
| ***C11D 7/42*** | (2006.01) |
| ***C11D 3/386*** | (2006.01) |
| ***C11D 3/48*** | (2006.01) |
| ***C11D 7/34*** | (2006.01) |
| ***C11D 7/50*** | (2006.01) |
| ***C11D 11/00*** | (2006.01) |
| *C11D 7/26* | (2006.01) |

(52) U.S. Cl.
CPC ..... *C11D 3/38618* (2013.01); *C11D 3/0026* (2013.01); *C11D 3/48* (2013.01); *C11D 7/34* (2013.01); *C11D 7/5022* (2013.01); *C11D 11/0041* (2013.01); *C11D 7/263* (2013.01)

(58) Field of Classification Search
USPC ..... 510/161, 407, 392, 393, 530
See application file for complete search history.

(56) References Cited

U.S. PATENT DOCUMENTS

| | | | | |
|---|---|---|---|---|
| 4,959,179 | A * | 9/1990 | Aronson et al. | 510/393 |
| 5,082,585 | A | 1/1992 | Hessel | |
| 5,437,686 | A * | 8/1995 | Heffner et al. | 8/111 |
| 5,891,836 | A * | 4/1999 | Kacher | 510/237 |
| 5,997,764 | A * | 12/1999 | Ambuter et al. | 252/186.25 |
| 6,083,897 | A | 7/2000 | Lewis | |
| 2004/0026665 | A1 * | 2/2004 | Griese et al. | 252/364 |
| 2004/0209790 | A1 * | 10/2004 | Sava et al. | 510/161 |
| 2005/0020466 | A1 * | 1/2005 | Man et al. | 510/392 |

FOREIGN PATENT DOCUMENTS

| | | |
|---|---|---|
| GB | 1286054 | 8/1972 |
| JP | 47003733 | 9/1972 |
| JP | 63135123 | 6/1988 |
| JP | 2000506516 | 5/2000 |
| JP | 2001031999 | 2/2001 |
| JP | 2002535439 | 10/2002 |
| JP | 2003530447 | 10/2003 |

OTHER PUBLICATIONS

IPRP of PCT/AU2007/000999, Jun. 6, 2008, Novapharm.
ISR of PCT/AU2007/000999, Aug. 16, 2007, Novapharm.

* cited by examiner

*Primary Examiner* — Ling Choi
*Assistant Examiner* — Thuy-Ai Nguyen
(74) *Attorney, Agent, or Firm* — Locke Lord LLP

(57) ABSTRACT

Liquid compositions for cleaning, in particular medical instruments and air conditioning surfaces, said composition excluding surfactants and comprising one or more enzymes including a protease and optionally a hydrolase, a solvent system including a water soluble glycol ether solvent, at least one anionic hydrotrope, and wherein the molar ratio of said at least one hydrotrope to said glycol ether in the composition is selected to preserve the activity of said one or more enzymes. The hydrotrope is advantageously an anionic hydrotrope selected from the group consisting of water soluble anionic hydrotropes of the formula (I) and having no alkyl side chain greater than six carbons in length, for example a xylene sulfonate or cumene sulfonate salt.

(I)

20 Claims, 2 Drawing Sheets

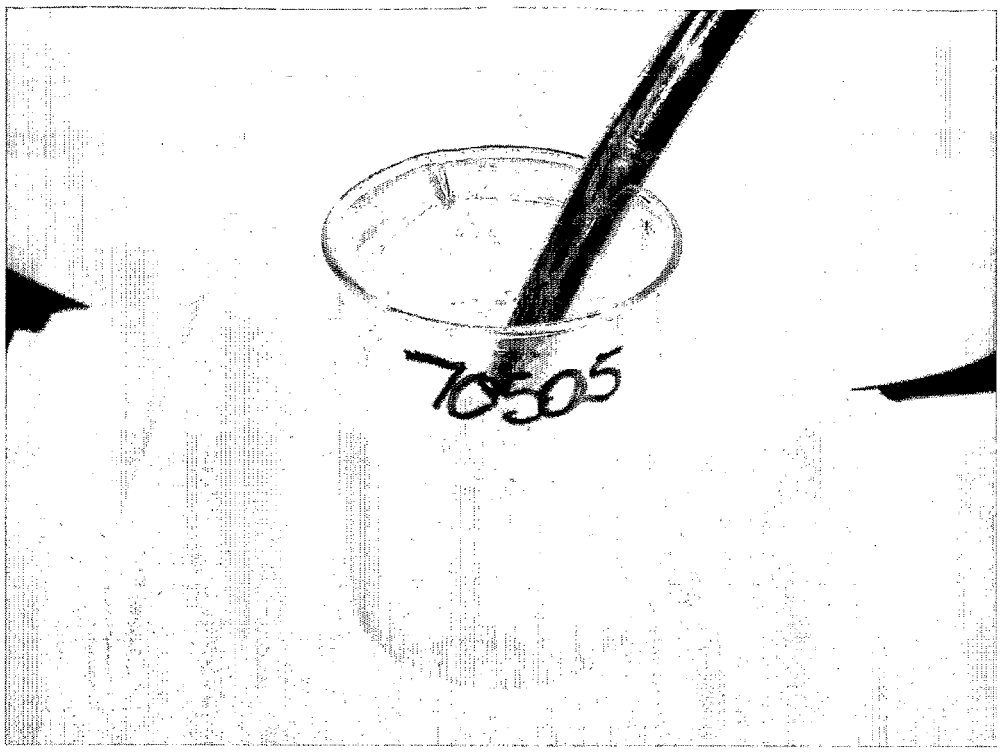
Figure 3 (prior art)
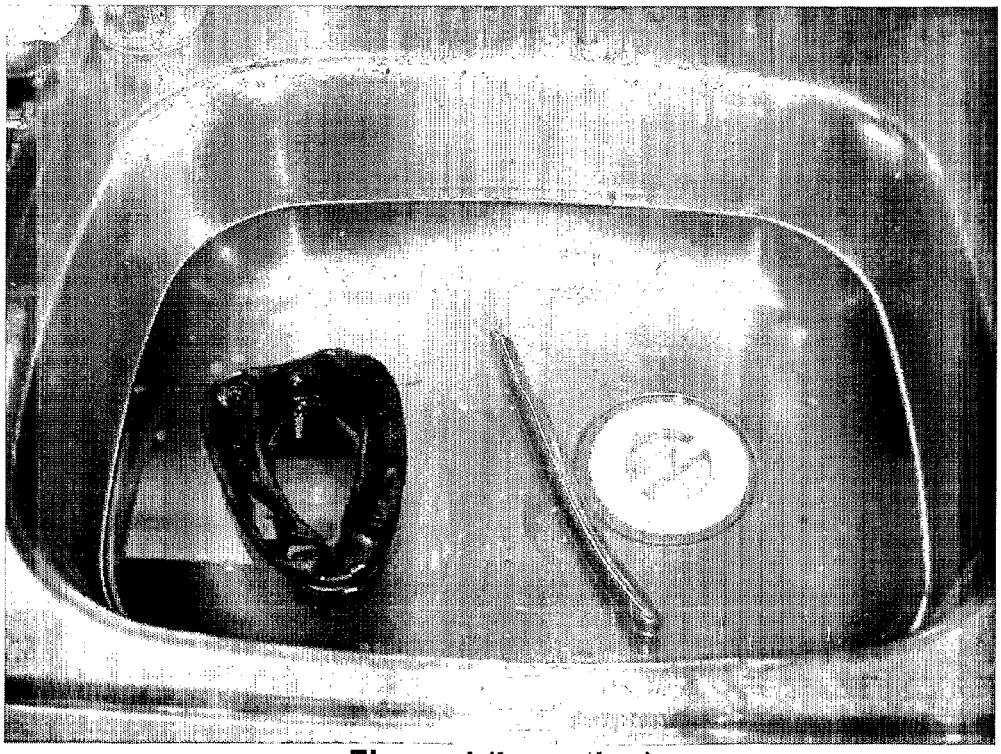
Figure 4 (invention)

LOW FOAMING CLEANER

PRIOR RELATED APPLICATIONS

This application is a national stage of application PCT/AU2007/000999, which has an international filing date of Jul. 18, 2007 and which claims priority to Australian applications AU2007900582, filed Feb. 7, 2007, and AU2006903863, filed Jul. 18, 2006. The PCT application and both Australian applications are each incorporated herein in their entirety.

FEDERALLY SPONSORED RESEARCH STATEMENT

Not applicable.

REFERENCE TO MICROFICHE APPENDIX

Not applicable.

FIELD OF THE INVENTION

This invention relates to a composition for use for general cleaning, and in particular for use in cleaning medical instruments and which is effective for soil removal and protein digestion while remaining low foaming.

BACKGROUND

The incidence has been widely reported of post procedural infections associated with surgery or diagnostic studies. It is believed that a significant number of these infections are due to inadequate reusable instrument reprocessing.

Cleaning of instruments on an industrial scale involves two steps. In the first step the instrument is cleaned and in the second step it is disinfected normally to "high level disinfection" or "sterilization" standards. It is generally accepted that failure to adequately clean items after use in the first step may compromise the efficacy of the second. The elimination of human proteins from the instruments represents a significant challenge. The challenge has been made more difficult as medical instruments have been developed, for example endoscopes, which utilize materials that are neither temperature resistant nor chemically inert.

For effective cleaning of medical instruments a preparation should be effective for soil removal, effective for protein digestion and resist foaming. In addition, the products are required to have stability and a long shelf life.

These desiderata tend to be mutually inconsistent objectives. In order to avoid foaming, soil removal preparations used in hospital cleaning/sterilizing "reprocessing" systems have mainly utilized highly alkaline non-foaming detergents, but their use is incompatible with both enzymes, and with materials of construction of flexible endoscopes. The use of close to neutral "enzymatic detergents" (preparations including both enzymes and detergents) has been found to be relatively effective for removal of proteins and safe with endoscopes, and enables acceptable levels of soil removal to be achieved. However, while enzymes in "enzymatic detergents" help to remove proteins, surfactants have been needed to remove the fats and carbohydrates. Due to the incorporation of surfactants, "enzymatic detergents" tend to produce foam to an unacceptable extent.

Foaming is undesirable because it blocks the visualization of instruments in manual cleaning baths, impedes access of washing liquor to soils during manual cleaning and blocks water jets and washing liquor circulation in automated washers (e.g., tunnel washers). The foams tend to block the lumens of instruments preventing effective cleaning of the lumen interior. When enzyme based cleaners have been used in reprocessing machinery the foam tends to fill the volume thus impeding the cleaning cycle by disrupting jets and agitation. Furthermore it makes the machine difficult to unload, interfering with proper draining, and leaving foam residues containing pathogens which can contaminate following cleaning cycles giving rise to significant risk of cross infection since the cleaners do not kill the microorganisms which they dislodge from surfaces. Instruments covered with foam require additional handling and washing before they can be sterilized. Increasingly the additional labour cost, time, and water consumption costs are regarded as unacceptable. Multiple guidelines and standards recognise the problem and warn against using foaming detergents for cleaning medical instruments (e.g., AS 4187:2003 or AS 4815:2006).

Although this problem has been recognized, it has not to date been satisfactorily overcome. Two solutions to the foaming problem have been utilized, however to date neither approach has succeeded in satisfying the market need.

In the first approach antifoams have been added to the cleaning composition or washer, but that has been unsatisfactory because antifoams leave unacceptable residues on the medical instruments. In the second approach attempts have been made to use so called "low foaming" non-ionic detergents such as alkylene oxide adducts. These tend to leave an undesirable film of oily residue on treated surfaces similar to that from antifoams and also produce hazy solutions which reduce visibility during washing cycles.

As a consequence commercially available formulations results tend to be either inadequately cleansing, or high foaming, and thus not suitable for use for cleaning medical instruments, or tend to be unstable and possess an inadequate shelf life, due to denaturing of the enzymes by surfactants employed.

Cheetham (Australian Infection Control, Sep. 2005, 10, 3, p 103-109) compared 17 market leading enzyme based medical instrument cleaners from eight manufacturers (Table 1).

TABLE 1

Products compared by Cheetham

| PRODUCT | SUPPLIER/MFR |
|---|---|
| Cidezyme/Enxol | Johnson & Johnson |
| Endozyme | Ruhof |
| Endozyme AW plus | Ruhof |
| 3E-zyme/Omni-Zyme | Medisafe |
| Lapcholyzime | Ruhof |
| 3M Rapid Multi-Enzyme Cleaner 70500 | 3M |
| 3M Rapid Multi-Enzyme Cleaner 70501 | 3M |
| 3M Rapid Auto Multi-Enzyme Cleaner 70505 | 3M |
| Matrix | Whiteley Med. |
| Mediclean | Neodisher |
| Mediclean Forte | Neodisher |
| Medizym | Dr Weigert |
| Medizyme | Whiteley Med. |
| Mucadont Zymaktiv | Merz |
| Mucapur ER | Dr Weiger |
| Orthozime | Ruhof |
| Pacer Release | Campbell Bros. |
| Prepzyme | Ruhof |

(Australian Infection Control, September 2005, 10, 3, p 103-109)

The products were tested using SDS-PAGE methodology to compare the molecular weights of a group of standardised blood proteins before and after exposure to the various cleaning products. Cheetham reported that half of the products tested, when used in accordance with the manufacturers' directions, exhibited little or no protein digestion, and only two of the products (Rapid 70500 and Rapid 70501—both from 3M and also known as RMEC 70500 and RMEC 70501 respectively) provided a high degree of protein digestion. Cheetham did not report on foaming properties or stability. The present Applicant has tested the two products which provided a high degree of protein digestion and found that one exhibits high level of foaming while the other contains alkylene oxide block copolymer and leaves undesirable oily residues on the treated surface. Moreover, while both exhibit good stability with easily inhibited enzymes, both show poor stability with difficult to inhibit enzymes.

Further, whilst the problem has been outlined with respect to cleaning medical instruments, the desire for cleaning compositions which are efficacious in removing soil and digesting proteins whilst resisting foaming is not limited to the field of cleaning medical instruments. Such properties, along with stability and a long shelf life, are desirable in many different cleaning applications.

A further area where low foaming cleaning compositions are desirable is in the area of air conditioning and cooling. For instance, fresh food cool rooms have their temperature controlled by a refrigeration unit fitted with fans which is integral with the room. The fans draw environmental air through a refrigerated cooling coil heat exchanger into the room. The process of cooling the air results in a lowering of humidity with the moisture being condensed onto the cold surfaces of the heat exchanger. It is well known that any environmental surface which is continually wet or damp will become covered in biofilm. This biofilm not only reduces heat exchange efficiency, but is a very significant potential source of microbiological contamination into the room and is therefore undesirable.

There currently are only limited number of existing methods of removing biofilm from heat exchange coils. The biofilm may be removed with abrasive brushes or high pressure water. This has proved to be problematic because the spaces between the cooling fins are insufficient to allow efficient brushing and the surface areas so extensive as to make this brushing an extremely tedious process. High pressure water has proven to be undesirable because it damages the cooling fins which are made of thin aluminium sections.

Alternatively, the heat exchange coil may be washed with strong alkali or strong acid. This has proved to be problematic because the alkali or acid, whilst eventually removing the biofilm both causes significant corrosive damage to the aluminium fins and the copper refrigeration tubes to which they are attached. This corrosion severely limits the service life of the heat exchange coil.

Thus, it is desirable to have effective yet non-corrosive cleaning agents that act without producing large quantities of foam.

Any discussion of the prior art throughout the specification should in no way be considered as an admission that such prior art is widely known or forms part of common general knowledge in the field.

OBJECT OF THE INVENTION

It is an object of the present invention to provide an improved composition for cleaning, and in particular cleaning medical instruments which avoids or ameliorates at least some of the disadvantages of prior art. It is an object of preferred embodiments of the present invention to provide a composition for cleaning, and in particular cleaning medical instruments which is low foaming, has excellent enzyme shelf stability and is effective for soil removal and protein digestion.

BRIEF STATEMENT OF THE INVENTION

The present invention provides liquid compositions which provide high levels of soil removal, exhibit superior protease stability, and minimize foaming to acceptable levels without leaving undesirable levels of residues. The compositions exhibit very high enzyme shelf life stability.

In a broad aspect, the invention provides a liquid for cleaning, said composition excluding surfactants and comprising one or more enzymes including a protease, a solvent system including a water soluble glycol ether solvent, at least one anionic hydrotrope, and wherein the molar ratio of said at least one hydrotrope to said glycol ether in the composition is selected to preserve the activity of said one or more enzymes.

According to a first aspect the invention provides a liquid composition for cleaning medical instruments, said composition excluding surfactants and comprising one or more enzymes including a protease, a solvent system including a water soluble glycol ether solvent, at least one anionic hydrotrope, and wherein the molar ratio of said at least one hydrotrope to said glycol ether in the composition is selected to preserve the activity of said one or more enzymes.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

In preferred embodiments the composition includes several additional hydrolase enzymes in addition to a protease or proteases, said hydrolase enzymes including but not limited to lipases, cellulases and amylases.

Desirably, the hydrotrope is an anionic hydrotrope selected from the group consisting of water soluble anionic hydrotropes of the formula:

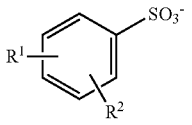

and more preferably of the formula

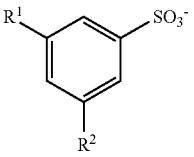

and having no alkyl side chain greater than six carbons in length.

In preferred hydrotropes $R^1$ and $R^2$ are independently alkyl groups of from 1 to six carbons, although $R^1$ or $R^2$ may optionally be hydrogen. Preferred hydrotropes have a short chain (less than six, and preferably from one to four carbons, and more preferably from one to two carbons). Very highly preferred hydrotropes are water soluble xylene sulfonate ($R^1$ is methyl, $R^2$ is methyl) and cumene sulfonate ($R^1$ is isopropyl, $R^2$ is hydrogen) salts.

Since both anionic hydrotropes and glycol ether solvents are considered strong protein (and enzyme) denaturing agents it is surprising that compositions according to the invention possess all the above desiderata:

non foaming excellent enzyme shelf-life stability excellent cleaning performance against standard medical soils leaves no undesirable residues According to a second aspect the invention provides a composition according to the first aspect wherein the molar ratio of hydrotrope:glycol ether is selected to be greater than 1.1:1. More preferably the weight ratio of hydrotrope:glycol ether is greater than 1.2:1 or better still is greater than 1.5:1.

According to a third aspect the invention provides a composition according to the first or second aspect in a concentrate adapted to be diluted for use by at least 20 parts of water to 1 part of the concentrate (100 to 1000 parts of water to 1 part of concentrate in preferred embodiments) and wherein the hydrotrope is selected from the group comprising of water soluble aromatic sulfonates with one or more short ($C_1$-$C_6$) side alkyl chains.

According to a fourth aspect the invention provides a composition according to the first or second aspect wherein the solvent comprises in combination at least one glycol ether, at least one polyhydric alcohol, and water containing boron or borate ions.

According to a fifth aspect the invention provides a composition according to any one of the preceding aspects wherein each component of the composition is selected so as to exclude compounds incorporating an alkyl chain of longer than six carbons.

The concentration ratios are critical for prevention of enzyme deterioration on storage. The weight ratio of hydrotrope to proteolytic enzyme should be between 400:1 and 200:1, more preferably 300:1 and 350:1 and the concentration of hydrotrope should not exceed 25%. The molar ratio of glycol ether to polyhydric alcohols is preferably between 0.2:1 and 1:1.

The compositions of the present invention are particularly suited to cleaning medical instruments, and have been principally described with reference to that use, however, it will be appreciated that the cleaning compositions of the present invention are by no means limited to that use. They may be used in any circumstances where it is desired to clean biological matter from surfaces, including industrial and domestic applications, for example, in cleaning down any wet surface contaminated with proteinaceous materials, or cleaning refrigeration coils. The compositions of the present invention have been found to be especially efficacious for cleaning the interior of cooling towers and the heat exchange surfaces of heat exchange equipment involving water.

EXAMPLES

Compositions According to the Invention are Shown in Examples 1, 2, 3

These differ from each other primarily in that the molar ratio of sodium xylene sulfonate to glycol ether in the compositions is 1.1:1; 1.2:1, and 1.6:1, respectively.

Example 1

Molar Ratio Hydrotrope to Glycol Ether 1.1:1

| Component | Preferred % w/w |
|---|---|
| Sodium xylene sulfonate | 13.8 |
| proteolytic enzyme | 0.06 |
| Selected other enzymes | 0.02 |
| glycerol | 4.1 |
| Propylene glycol | 12 |
| glycol ether | 8.9 |
| Preservative | 0.1 |
| Borax | 4.1 |
| 5% Calcium solution | 0.5 |
| water | balance |

Example 2

Molar Ratio Hydrotrope to Glycol Ether 1.2:1

| Component | Preferred % w/w |
|---|---|
| Sodium xylene sulfonate | 16 |
| protease | 0.09 |
| Selected other enzymes | 0.01 |
| glycerol | 5 |
| Propylene glycol | 4 |
| glycol ether | 9.5 |
| Preservative | 0.1 |
| Borax | 2 |
| 5% Calcium solution | 0.5 |
| water | balance |

Example 3

Molar Ratio Hydrotrope to Glycol Ether 1.6:1

| Component | Preferred % w/w |
|---|---|
| Sodium xylene sulfonate | 15 |
| protease | 0.05 |
| Selected other enzymes | 0.02 |
| glycerol | 6 |
| Propylene glycol | 5 |
| glycol ether | 6.6 |
| Preservative | 0.1 |
| Borax | 3 |
| 5% Calcium solution | 0.1 |

Comparative examples 4, 5 are similar to example 1 except that the mole ratio of hydrotrope to glycol ether is 1.0:1.0 in example 4; and is 0.9:1 in example 5.

Comparative Examples 4 and 5

| | Comparative Example 4 | Comparative Example 5 |
|---|---|---|
| Ratio of hydrotrope to glycol ether | 1.0:1 | 0.9:1 |
| Sodium xylene sulfonate | 18 | 15 |
| Protease | 0.07 | 0.09 |
| Selected other enzymes | 0.02 | 0.02 |

-continued

| | Comparative Example 4 | Comparative Example 5 |
|---|---|---|
| Glycerol | 3.6 | 5 |
| Propylene glycol | 4 | 4 |
| glycol ether | 12.7 | 11.7 |
| Preservative | 0.8 | 0.8 |
| Borax | 2 | 6 |
| 5% Calcium solution | 0.5 | 0.5 |

In use, compositions according to the invention may be stored as concentrates for periods of at least 18 months at 25° C. and should be diluted by tap water from 20:1 to 1000:1 before use.

Table 2 below summarises the performance of the best of the compositions evaluated by Cheetham as referred to above and identified in Table 1. Table 2 compares in summary form 12 commercially available cleaners in terms of shelf life protease stability (columns 2 and 3), soil removal efficacy (column 4), residual foam height (column 5) and presence of potential residue. The three most effective commercially available compositions in terms of soil removal were Cidezyme, 3M Rapid 70505 and 3M 70500 all of which scored 10. However, of these 3M Rapid 70500 produced a residual foam height of 500 ml which is unacceptable, while 3M rapid 70505 left an oily residue which is also unsatisfactory. The Cidezyme passed the residual foam height test without any residue. However Cidezyme failed on both the stable and unstable proteases shelf life stability tests. In comparison formulations according to examples 1, 2, 3 of the invention achieved excellent soil removal and passed each of the tests.

TABLE 2

| Enzymatic detergent | Stable protease shelf life (Test A) | Unstable protease shelf life (Test B) | Soil Removal Test (10 = best; 0 = worst) | Foam volume Test, ml at 25 C. | Residue Presence test |
|---|---|---|---|---|---|
| Dr2000 NT-1 | fail | fail | 7 | fail | |
| Orthozyme | fail | fail | 3 | fail | |
| Pacer Release | fail | fail | 7 | fail | |
| Omnizyme | fail | fail | 6 | pass | pass |
| Medizyme | nt | nt | 6 | fail | |
| Lapcholyzime | nt | nt | 5 | pass | pass |
| Endokleen | fail | fail | 4 | fail | |
| Endozyme | nt | fail | 6 | fail | |
| Endozyme AW plus | fail | fail | 6 | fail | |
| Cidezyme | fail | fail | 10 | pass | pass |
| 3M Rapid Auto 70505 | pass | fail | 10 | pass | fail |
| 3M Rapid Auto 70500 | pass | fail | 10 | fail | pass |
| Invention Example 1 | pass | pass | 10 | pass | pass |
| Invention Example 2 | pass | pass | 10 | pass | pass |
| Invention Example 3 | pass | pass | 10 | pass | pass |

Table 3 below shows the results for comparative examples 4 and 5. These examples differ from examples 1 to 3 in that the molar ratio of hydrotrope to glycol ether is not selected to preserve the activity of said one or more enzymes, and is below 1.0:1 and 0.9:1 respectively. This shows that to achieve stability for the compositions exemplified the mole ratio of hydrotrope to glycol ether should be selected to be above 1.1:1. However the ratio required to be selected could be determined for other compositions within the scope of the invention having regard to the teachings herein disclosed.

TABLE 3

| Enzymatic detergent | Protease stability Test A | Protease Stability Test B | Soil Removal Test (10 = best; 0 = worst) | Residual Foam Test | Residue test |
|---|---|---|---|---|---|
| Comparative example 4 | fail | fail | 10 | pass | Pass |
| Comparative example 5 | fail | fail | 10 | pass | pass |

Details of the tests used and results obtained to prepare the data in tables 2 and 3 above are given below:

1. Soil Removal Test

Scope: This method allows for a qualitative and/or quantitative assessment of the relative efficacy of cleaners and detergents in removing a simulated medical soil.

Browne indicator strips—STF load check indicators (Albert Browne Ltd Leicester UK)—are designed to ensure and assist in documenting the cleaning efficacy of tunnel washers, single chamber washer-disinfectors, etc. The indicator consists of a plastic substrate, with a patch of protein-based soil applied to both sides. This simulates a very difficult to remove medical soil. The amount of soil remaining on the strip after detergent treatment can be assessed visually.

Preparation of Samples for Soil Removal Test 125 ml beakers with 99±0.5 ml of tap water are placed in a water bath to equilibrate to required temperature for approximately 30 minutes.

The required amount of test product/sample detergent is then added to each beaker and stirred gently. One beaker is left as a control with the addition of 1 ml of water instead of test product. These solutions are left for a further 5 minutes to equilibrate to temperature.

Browne STF Load Check Indicator strips (Browne strip) are cut in half (to give two test strips) and then added to each beaker. The dimensions of the beaker are selected to enable the strip to be positioned at an angle whilst being fully submerged in the test solution.

At the end of the prescribed time interval the strips are carefully removed with clean tweezers ensuring that no contact is made with the soiled patch on either side of the strip. The strips were then dipped in clean tap water briefly and then allowed to drip dry. After drying the strips are placed on white paper and photographed for visual assessment.

Estimation of the Degree of Soil Removal.

The degree of soil removal is generally measured on a scale of 0 to 10, with 0 being the lowest degree (No visible soil removal) and 10 being the highest degree (complete soil removal).

(b) Soil Removal Results.

The best commercially available enzymatic detergents (per Cheetham—see appended table 1) were compared with formulations according to the invention using the soil removal test described above with the results shown in Table 4.

TABLE 4

| Enzymatic detergent | Removal Test (10 = best; 0 = worst) |
|---|---|
| Dr2000 NT-1 | 7 |
| Orthozyme | 3 |
| Pacer Release | 7 |
| Omnizyme | 6 |
| Medizyme | 6 |
| Lapcholyzime | 5 |
| Endokleen | 4 |
| Endozyme | 6 |
| Endozyme AW plus | 6 |
| Cidezyme | 10 |
| 3M Rapid Auto 70505 | 10 |
| 3M Rapid Auto 70500 | 10 |
| Invention Example 1 | 10 |
| Invention Example 2 | 10 |
| Invention Example 3 | 10 |
| Comparative example 4 | 10 |
| Comparative example 5 | 10 |

2. Protease Shelf Life Stability Tests

Scope: The test allows comparison of ingredients of enzymatic formulations in respect of their ability to preserve protease activity during storage. Enzymatic activity is known to decrease over time due to protein denaturing and auto-proteolysis (self-digestion). These processes are dramatically accelerated by increase in temperature—each 10 degrees temperature rise increases the rate of denaturing by up to 8 times. The loss of proteolytic activity over time is quantified for each product and expressed as percentage for each formulation.

Procedure:

Denature any remaining protease in cleaners under study by gentle boiling of each product for 2-3 min in a capped beaker, 1. Cool and confirm absence of proteolytic activity using protease test strips, 2. Add 10% w/w of test protease. In "Test A" a stable protease (Savinase Ultra 16XL, from Novozymes) is used. In "Test B" a relatively unstable enzyme (Savinase 16L, from Novazymes) is used. If practical, both the well stabilised and a poorly stabilised enzyme are used in the same assay—e.g. Savinase Ultra 16XL AND Savinase 16L from Novozymes.

3. Divide each prepared sample into three and store at 4, 25 and 40° C.

4. Assay and report initial protease activity

5. After 14 days assay remaining protease activity of each sample. Report the percentage of protease activity loss at each temperature.

A loss of 5% or less of initial protease activity for both stable and unstable proteases in table 5 is regarded as a "pass".

(b) Results for Stable and Unstable Protease Shelf Life Tests.

The results obtained for each of the compositions listed in table 4 in respect of stable and unstable Protease shelf life tests described above is shown in Table 5:

TABLE 5

| Enzymatic detergent | Stable protease shelf life Test A | Unstable protease shelf life Test B |
|---|---|---|
| Dr2000 NT-1 | 29.1 | 51 |
| Orthozyme | >35 | >50 |
| Pacer Release | >35 | >50 |
| Omnizyme | >35 | >50 |
| Medizyme | nt | nt |
| Lapcholyzime | nt | nt |
| Endokleen | >35 | >50 |
| Endozyme | nt | >50 |
| Endozyme AW plus | >35 | >50 |
| Cidezyme | 21.1 | 38.9 |
| 3M Rapid Auto 70505 | <5 | 11.5 |
| 3M Rapid Auto 70500 | <5 | 12.5 |
| Invention Example 1 | <5 | <5 |
| Invention Example 2 | <5 | <5 |
| Invention Example 3 | <5 | <5 |
| Comparative example 4 | 22.4 | 12.1 |
| Comparative example 5 | 19.5 | 16.1 |
| Comparative example 6 | 6 | 11.9 |

nt = not tested

3 Foam Volume Test and Residue Presence Tests

Principle (Foam Volume)

An increase in foam volume was determined by blending for 30 sees using a commercial type blender with glass jar at 25±1° C. agitated at ~6000 rpm, and then measuring the increase in total volume of test fluid including foam.

Apparatus

Blender: A Moulinex commercial blender was used. The glass jar was volume graduated (20-25 mL marks).

Procedure (Foam Volume)

1. Clean and rinse the blender with distilled water using 10 s blends and fresh samples of distilled water until blending develops no appreciable foam. If a foam persist, clean with alcohol, followed by at least three rinses with distilled water.

2. Using the manufacturer's recommended dilutions prepare 500 ml of solution.

3. Pour the test liquid into a clean glass bottle or jar and store it at 25°±1° C. for a minimum of 1 h and a maximum of 2 h in the constant temperature water bath deep enough so that the water level is at least 10 mm above the air/test fluid interface.

4. Pour the test liquid into the blender jar.

5. Measure and record the test liquid volume, disregarding any foam. Call this the initial volume I.

6. Blend for 30±1 s at selected speed.

7. Shut off the blender and immediately measure the total volume including foam. Subtract initial volume of solution (I) and report as foam volume.

A residual foam height of less than 100 is accepted as a "pass".

Residue Presence Test

Scope: Report oily residues, if present.

Method: Oily residues can be easily observed on glass slides using dissecting microscope and lateral lighting.

Pre cleaned microscope glass slides were dipped into diluted enzymatic cleaner and then gently rinsed by dipping the slide once into a beaker with distilled water. The slide was allowed to drip dry before assaying for presence of residues.

Any detectable residue is a "fail". No detected residue is a "pass".

(b) Results for Residual Foam Volume and Residue Presence Tests.

The results obtained for each of the compositions listed in table 4 in respect of the foam volume test and residue presence test described above is shown in Table 6:

TABLE 6

| Enzymatic detergent | Residual Foam Test | Residue detection test |
|---|---|---|
| Dr2000 NT-1 | >500 | fail |
| Orthozyme | 100 | pass |
| Pacer Release | 350 | pass |
| Omnizyme | <25 | pass |
| Medizyme | 150 | fail |
| Lapcholyzime | <25 | pass |
| Endokleen | 200 | fail |
| Endozyme | 175 | |
| Endozyme AW plus | 200 | |
| Cidezyme | <25 | pass |
| 3M Rapid Auto 70505 | <25 | fail |
| 3M Rapid Auto 70500 | >500 | pass |
| Invention Example 1 | <25 | pass |
| Invention Example 2 | <25 | pass |
| Invention Example 3 | <25 | pass |
| Comparative example 4 | <25 | pass |
| Comparative example 5 | <25 | pass |
| Comparative example 6 | <25 | pass |

By way of further example, appended FIGS. 1-4 illustrate differences in foaming/residue properties. FIGS. 1-4 simulate normal usage procedures in which a concentrate is measured into a container and then the required amount of water is added. The result is photographed without stirring.

FIG. 3 shows the other of the best performers (3M Rapid 70505). A visible undesirable milky residue is suspended in the cloudy liquid.

Figure 1:
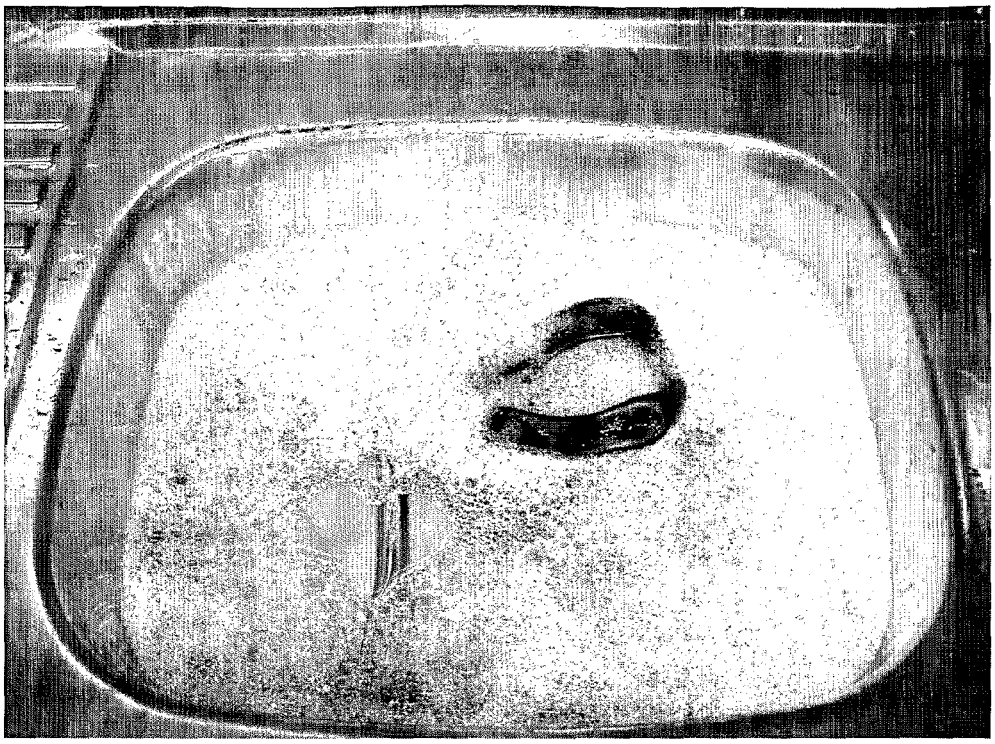
Figure 1 (prior art)
FIG. 1 shows medical instruments in a container filled with 3M Rapid Multi enzyme Cleaner 70500—one of the two best performers in the Cheetham study. The instruments are hardly visible because of foam.
Figure 2:
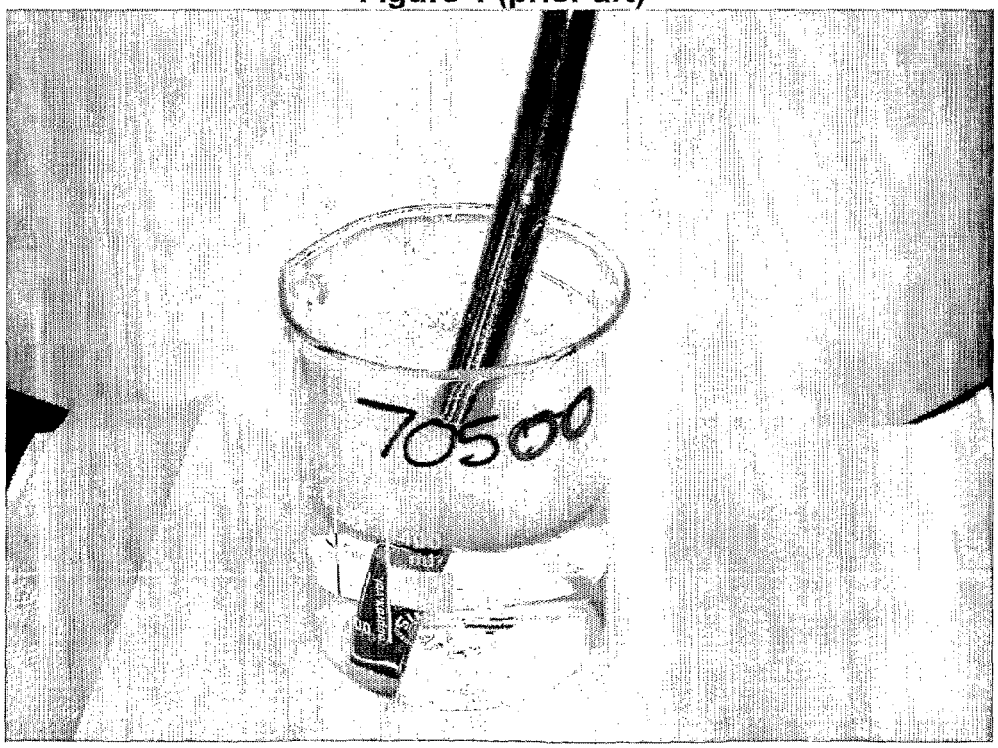
Figure 2 (prior art)
FIG. 2 shows the same product (3M Rapid Multi enzyme Cleaner 70500) in a beaker with a stable volume of foam above the liquid.

FIG. 4 corresponds to FIG. 1 when a composition according to the invention (example 2) is employed.

In the compositions exemplified the ratios of hydrotrope to protease and of DPM to polyhydric alcohols for each of the compositions is shown in table 7.

TABLE 7

| Composition | Ratio Hydrolase to protease | Ratio DPM to polyhydric alcohols |
|---|---|---|
| Example 1 | 230:1 | 0.3 |
| Example 2 | 177:1 | 0.6 |
| Example 3 | 300:1 | 0.34 |
| Comparative Example 4 | 257:1 | 0.93 |
| Comparative Example 5 | 166:1 | 0.73 |

Example 7

Cleaning Heat Exchanger

The low foaming compositions of the present invention was used to clean a heat exchanger. A two step process was employed.

Firstly the heat exchanger was sprayed with the enzymatic cleaner of the present invention such as described in Examples 1-3 above. The enzymatic cleaner is typically diluted at a rate of 50 parts water to 1 part enzymatic cleaner for very dirty heat exchangers and up to 100 parts of water to 1 part of enzymatic cleaner for less severely soiled heat exchangers.

The cleaner is allowed to soak into the contaminated surface in order to penetrate and digest biological matter. The soaking period is typically between 10 and 20 minutes depending on the depth of soil on the heat exchange surfaces.

Secondly, the heat exchanger was sprayed with low pressure water to remove the digested contaminants without physical damage to the fins. The digested contaminants were readily removed as the amount of foam obstruction of the coils was minimal.

This process was in contrast to carrying out the clearing with conventional enzymatic preparations which have a propensity to foam copiously during this spraying phase. The foam suspends contaminant particles and hides from view the areas which require further spraying.

Therefore the use of a very low foaming or non foaming enzymatic preparation has proved to be greatly advantageous.

Although the invention has been described with reference to specific examples, the formulations may be altered to an extent which will be apparent to those skilled in the art from the teaching hereof without departing from the scope of the inventive concepts herein disclosed.

The invention claimed is:

1. A liquid non-foaming composition for cleaning, consisting essentially of:

one or more enzymes including a protease;

a non-foaming solvent system including a water soluble glycol ether solvent; and at least one anionic hydrotrope, wherein the molar ratio of the at least one hydrotrope to the glycol ether in the composition is selected to preserve the activity of the one or more enzymes, wherein the non-foaming composition is surfactant free, and wherein the liquid non-foaming composition can be stored as a concentrate for at least 18 months at 25° C.

2. A liquid composition according to claim 1 wherein the composition includes additional hydrolase enzymes in addition to a protease or proteases, the hydrolase enzymes including lipases, cellulases and amylases.

3. A liquid composition according to claim 1 wherein the hydrotrope is an anionic hydrotrope selected from the group consisting of water soluble anionic hydrotropes of the formula:

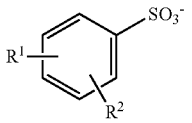

wherein $R^1$ and $R^2$ are independently hydrogen or alkyl groups of from one to six carbons.

4. A liquid composition according to claim 3 wherein the hydrotrope is an anionic hydrotrope selected from the group consisting of water soluble anionic hydrotropes of the formula:

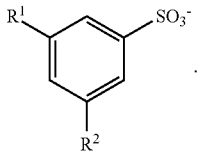

5. A liquid composition according to claim 3 wherein $R^1$ and $R^2$ have a chain from one to four carbons.

6. A liquid composition according to claim 3 wherein $R^1$ and $R^2$ have a chain from one to two carbons.

7. A liquid composition according to claim 1 wherein the hydrotrope is xylene sulfonate or cumene sulfonate salts.

8. A liquid composition according to claim 1 wherein the weight ratio of hydrotrope:glycol ether is selected to be greater than 1.1:1.

9. A liquid composition according to claim 1 wherein the weight ratio of hydrotrope:glycol ether is greater than 1.2:1.

10. A liquid composition according to claim 1 wherein the weight ratio of hydrotrope:glycol ether is greater than 1.5:1.

11. A liquid composition according to claim 1 in a concentrate adapted to be diluted for use by at least 20 parts of water to 1 part of the concentrate, and wherein the hydrotrope is selected from the group comprising of water soluble aromatic sulfonates with one or more $C_1$-$C_6$ alkyl side chains.

12. A liquid composition according to claim 1 wherein the non-foaming solvent system comprises in combination at least one glycol ether, at least one polyhydric alcohol, and water containing boron or borate ions.

13. A liquid composition according to claim 1 wherein each component of the composition is selected so as to exclude compounds incorporating an alkyl chain of longer than six carbons.

14. A liquid composition according to claim 1 wherein the weight ratio of hydrotrope to proteolytic enzyme is between 400:1 and 200:1.

15. A liquid composition according to claim 1 wherein the weight ratio of hydrotrope to proteolytic enzyme is between 300:1 and 350:1.

16. A liquid composition according to claim 1 wherein the concentration of hydrotrope does not exceed 25% by weight.

17. A liquid composition according to claim 1 wherein the molar ratio of glycol ether to polyhydric alcohols is between 0.2:1 and 1:1.

18. A liquid composition according to claim 1 formulated for use as a medical cleaner.

19. A liquid composition according to claim 1 formulated for use as an industrial cleaner.

20. A liquid composition according to claim 1 formulated for use in cleaning refrigerant coils.

* * * * *